United States Patent [19]

Piretti

[11] Patent Number: 4,618,027

[45] Date of Patent: Oct. 21, 1986

[54] FOLDING LADDER WITH THREE STILES

[75] Inventor: Giancarlo Piretti, Bologna, Italy

[73] Assignee: Castilia S.p.A., Italy

[21] Appl. No.: 790,016

[22] Filed: Oct. 22, 1985

[30] Foreign Application Priority Data

Jan. 14, 1985 [IT] Italy ..... 52842/85[U]

[51] Int. Cl.[4] ..... E06C 1/383

[52] U.S. Cl. ..... 182/35; 182/160; 182/162; 182/169; 182/171

[58] Field of Search ..... 182/156, 159, 160, 162, 182/169, 20, 35, 21, 171

[56] References Cited

U.S. PATENT DOCUMENTS

| | | | |
|---|---|---|---|
| 130,929 | 8/1872 | Mattern | 182/162 |
| 610,284 | 9/1898 | Schubert | 182/162 |
| 958,732 | 5/1910 | Dennis | 182/160 |
| 1,139,990 | 5/1915 | Merrill | 182/171 |
| 1,184,432 | 5/1916 | Dueber | 182/169 |
| 1,191,405 | 7/1916 | Daubenspeck | 182/35 |
| 1,265,922 | 5/1918 | Lanier | 182/35 |
| 1,371,125 | 3/1921 | Speckman | 182/160 |
| 2,088,878 | 8/1937 | Stogner | 182/162 |
| 2,981,364 | 4/1961 | Webber | 182/159 |
| 3,084,760 | 4/1963 | Lamberti | 182/160 |

*Primary Examiner*—Reinaldo P. Machado

*Attorney, Agent, or Firm*—Sughrue, Mion, Zinn, Macpeak, and Seas

[57] ABSTRACT

A ladder comprises a pair of main stiles, a series of centrally-hinged rungs with ends articulated to the two main stiles, whereby the ladder can adopt a folded inoperative configuration in which the main stiles are alongside each other and an extended operative configuration in which the main stiles are spaced from each other, and means for stopping the ladder in the extended operative configuration. The main stiles are articulated together at their upper ends and the ladder further includes a single auxiliary stile articulated at its upper end to the two upper ends of the main stiles about an axis substantially perpendicular to the articulation axis of the two main stiles. The auxiliary stile is movable between a position alongside the two main stiles, corresponding to the folded inoperative condition of the ladder, and a position spaced from the main stiles, corresponding to the extended operative condition of the ladder.

10 Claims, 11 Drawing Figures

FOLDING LADDER WITH THREE STILES

Figure 1:
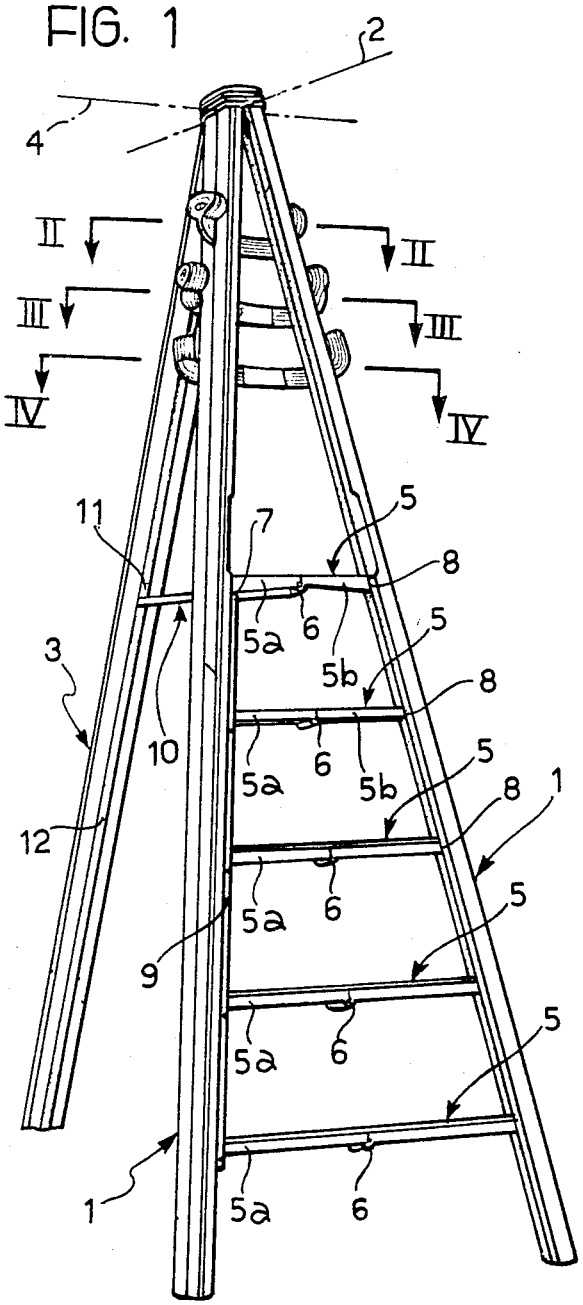

The present invention relates to a ladder of the type comprising:

a pair of main stiles, a series of centrally-hinged rungs with ends articulated to the two main stiles, whereby the ladder can adopt a folded inoperative configuration in which the main stiles are alongside each other and an extended operative configuration in which the main stiles are spaced from each other, and means for stopping the ladder in the extended operative configuration.

A ladder of the type specified above is described and illustrated, for example, in U.K. Pat. No. 923,792.

The object of the present invention is to provide a new design of ladder of the type specified above, which is simpler and more practical than those made until now.

In order to achieve this object, the invention provides a ladder of the type indicated at the beginning of the present description, characterised in that the main stiles are articulated together at their upper ends, and in that the ladder further includes a single auxiliary stile articulated at its upper end to the two upper ends of the main stiles about an axis substantially perpendicular to the axis of articulation of the two main stiles, the auxiliary stile being movable between a position alongside the two main stiles, corresponding to the folded inoperative condition of the ladder, and a position spaced from the main stiles, corresponding to the extended operative condition of the ladder.

According to a further characteristic, each rung of the ladder has stop surfaces at its ends for cooperating with the main stiles to hold the rung in the extended operative configuration. Moreover, the stop means include a tie rod having one end articulated to one of the rungs of the ladder and the opposite end slidable in a longitudinal guide groove formed in the auxiliary stile.

In order to facilitate the closure of the ladder, the rungs are articulated to a single connecting rod, so that the movement of any one rung towards the folded condition causes a corresponding movement of all the other rungs of the ladder.

In a preferred embodiment, the two main stiles are formed by two profiled elements of channel section, with the channels open towards each other. Preferably, the two main stiles have a pair of recesses formed in two respective longitudinal edges which are alongside each other in the folded inoperative condition of the ladder, so as to define an aperture in this condition into which the user can put his hands to move the main stiles away from each other.

Preferably, the ladder according to the invention also has auxiliary appendages and a support base for allowing the ladder to be used as a coat stand when in its folded inoperative condition.

In the preferred embodiment, the auxiliary appendages are each defined by a single element passing through two apertures formed respectively in two of the three stiles of the ladder and having ends in the form coat hooks located outside these two stiles. The support base has a seat for receiving with a positive fit the lower ends of the stiles of the ladder in the folded configuration of the latter, so as to ensure the necessary stability for use as a coat stand.

Figure 5:
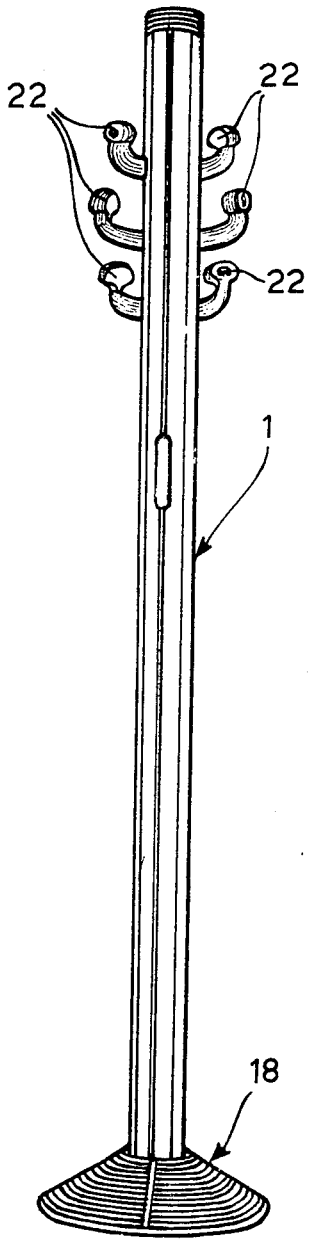
Figure 2:
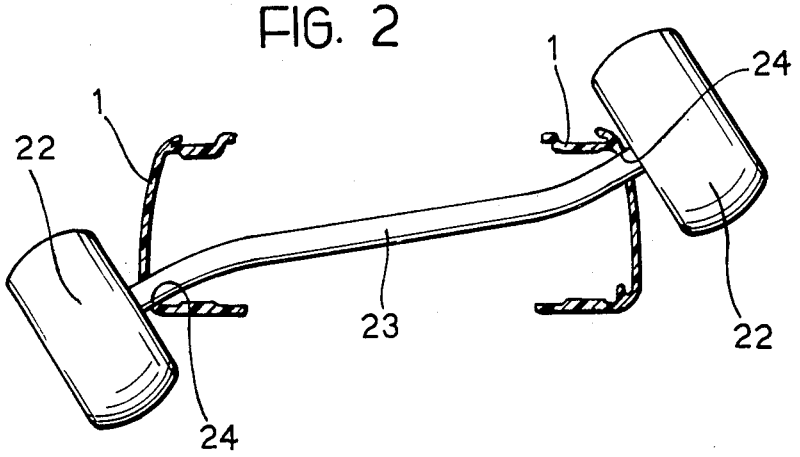
Figure 3:
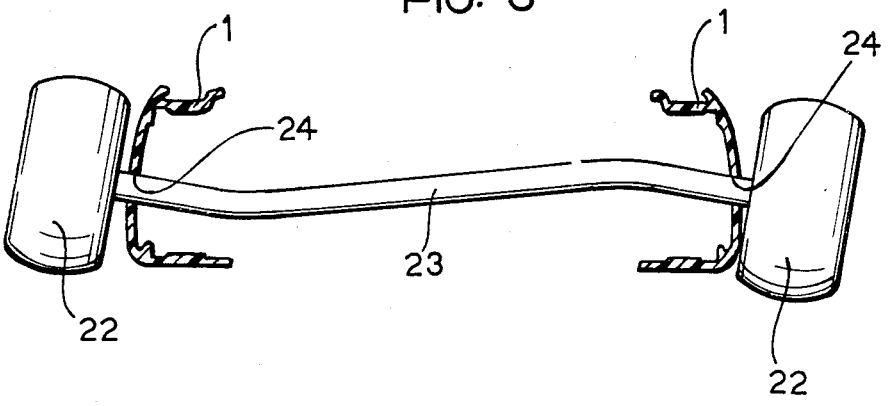
Figure 4:
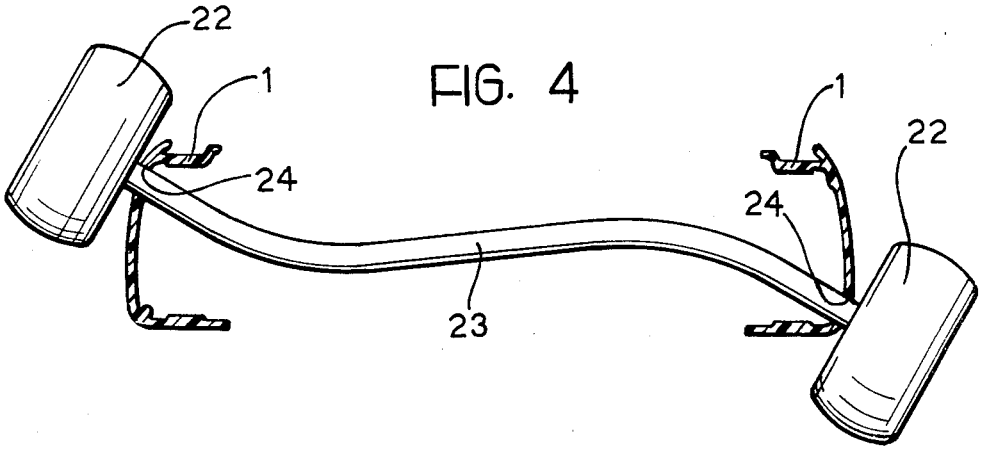
Figure 6:
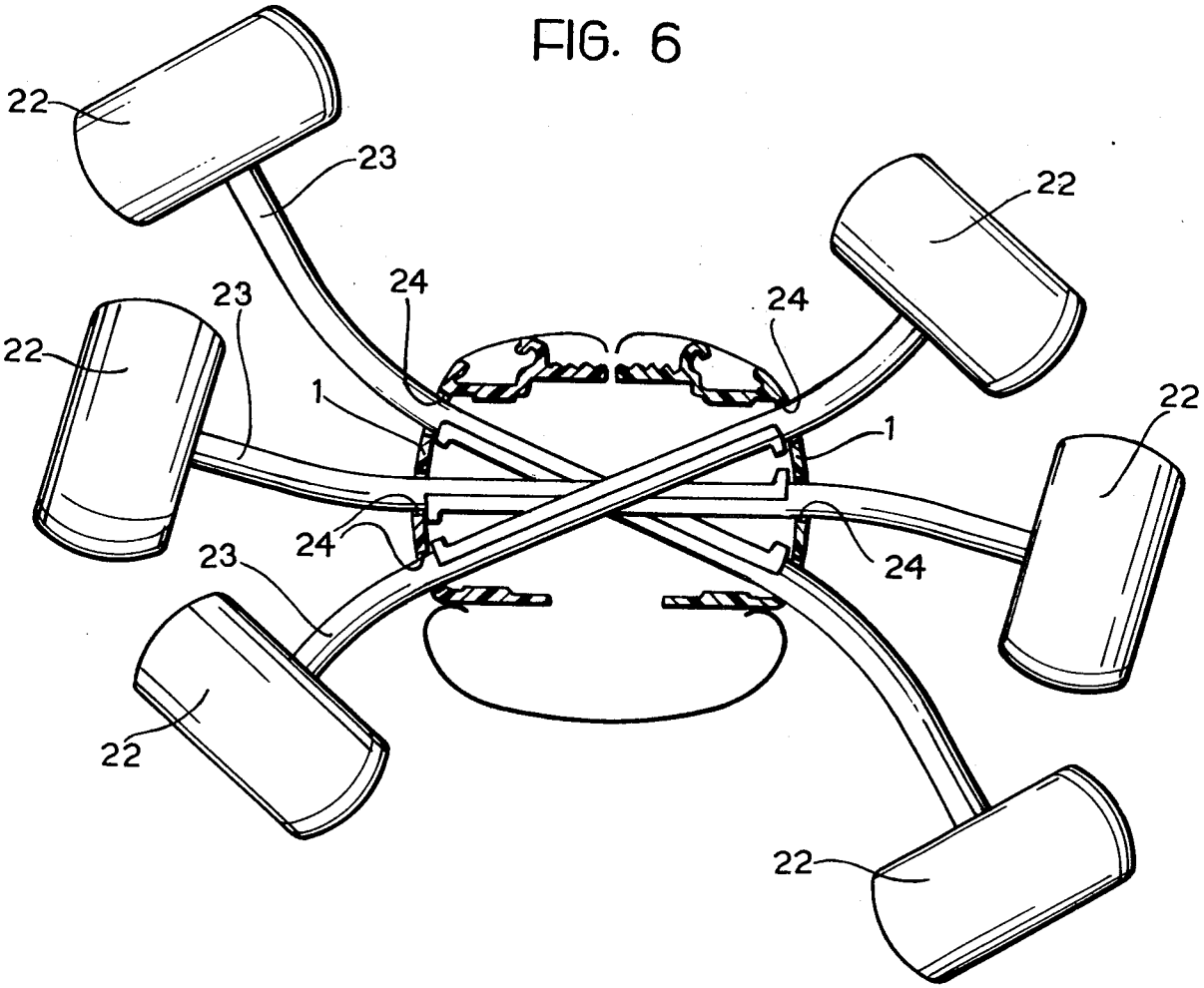
Figure 7:
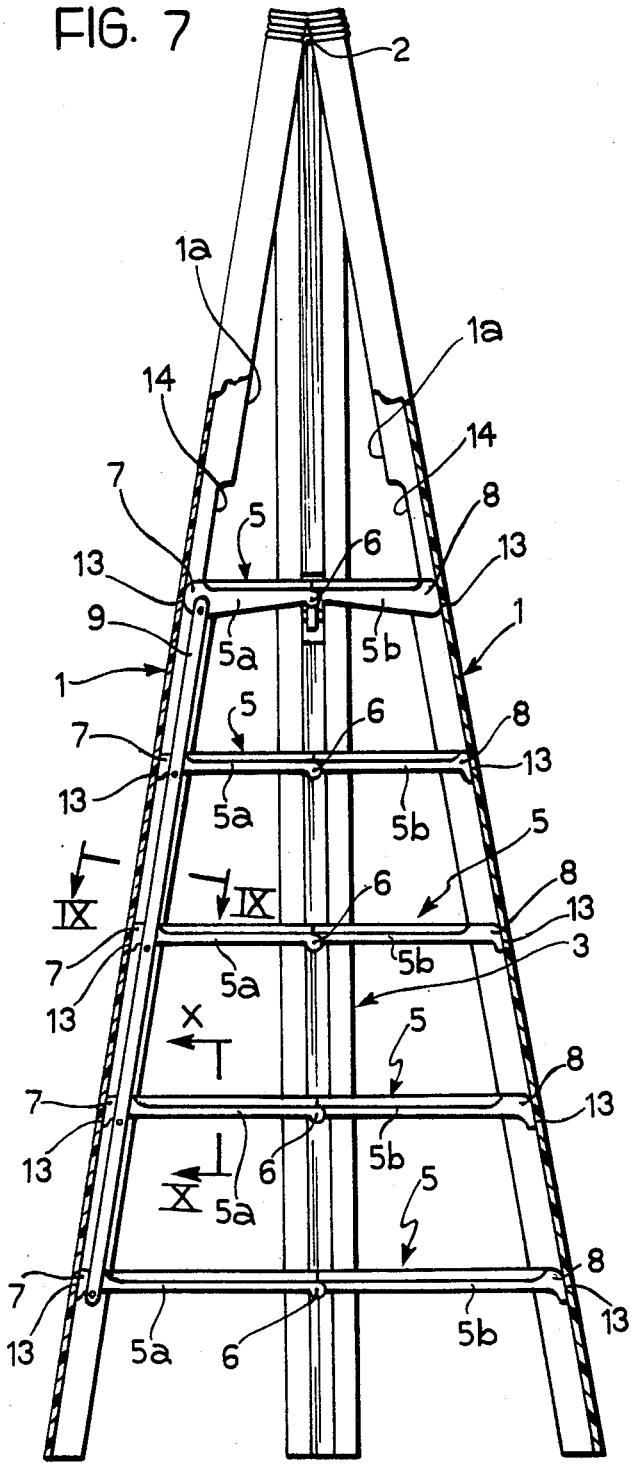
Figure 8:
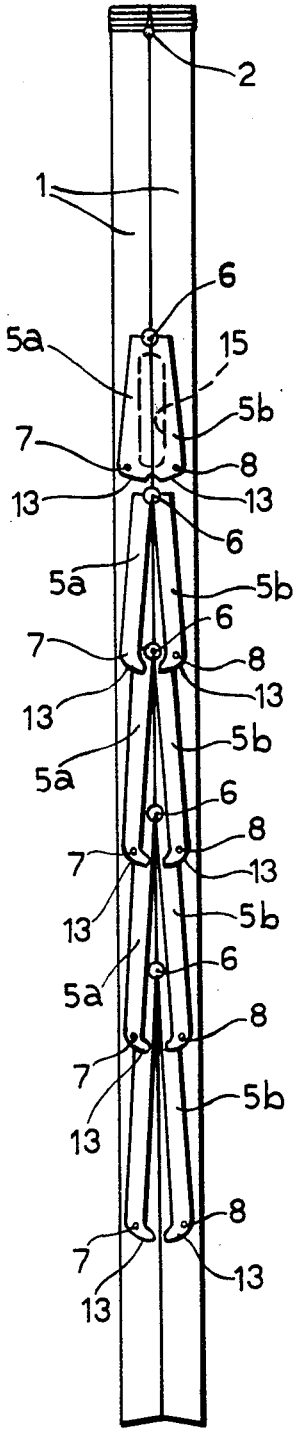
Figure 9:
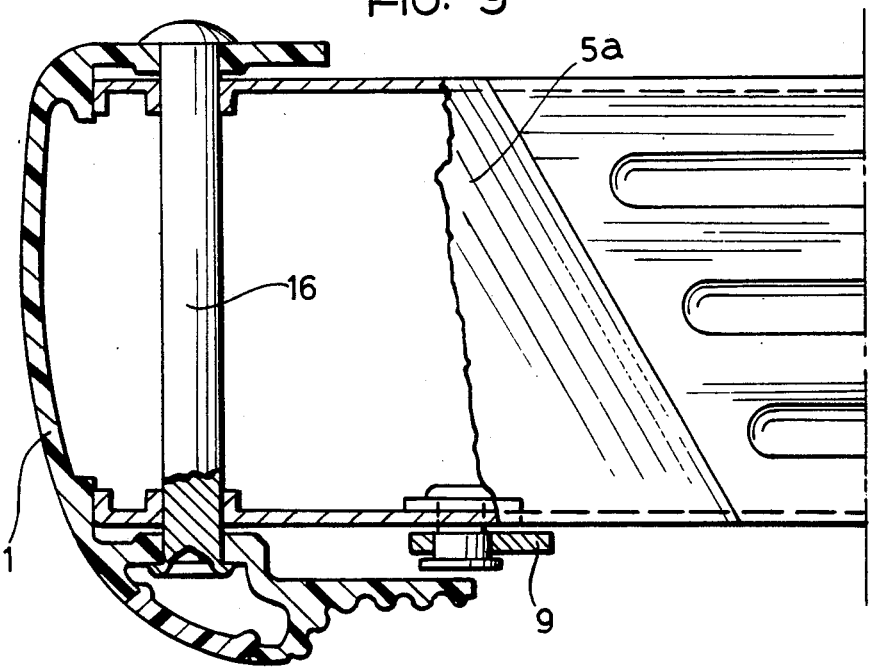
Figure 10:
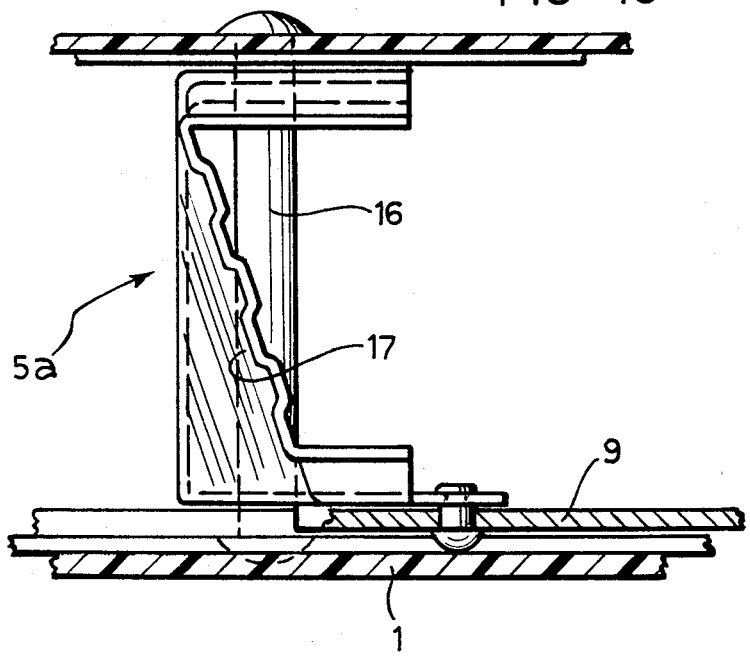
Figure 11:
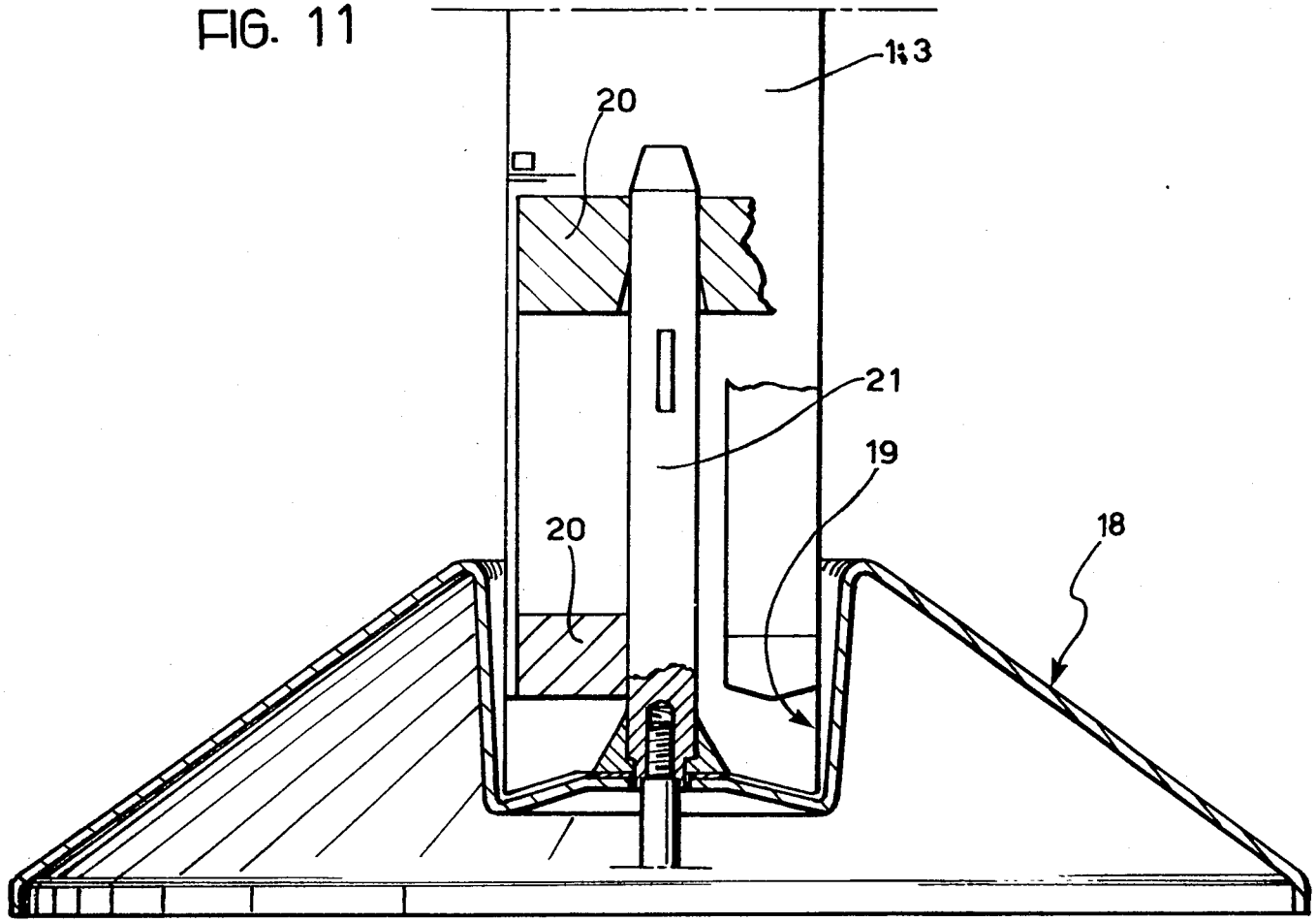

Further characteristics and advantages of the invention will become apparent from the description which follows with reference to the appended drawings, provided purely by way of non-limiting example, in which:

FIG. 1 is a perspective view of a ladder according to the invention in its extended operative condition, FIGS. 2 to 4 are sections taken on the lines II—II, III—III and IV—IV of FIG. 1, FIG. 5 is a perspective view of the ladder of FIG. 1 in its folded inoperative condition, in which the ladder is converted into a coat stand, FIG. 6 illustrates the three sections corresponding to FIGS. 2 to 4 in a superposed position in the folded condition of the ladder, FIG. 7 is a front view of the ladder in the extended operative condition, FIG. 8 is a schematic sectional view of the ladder in its folded inoperative condition, FIGS. 9 and 10 illustrate two sections taken on the lines IX—IX and X—X of FIG. 7, and FIG. 11 is a section on an enlarged scale showing a detail of FIG. 5.

With reference to the drawings, and in particular to FIGS. 1, 5, 7 and 8, the ladder according to the invention includes a pair of main stiles 1 having their upper ends articulated together about an axis 2, and a single auxiliary stile 3 having its upper end articulated to the upper ends of the main stiles 1 about an axis 4 substantially perpendicular to the axis 2.

The ladder includes a series of centrally-hinged rungs 5 with ends articulated to the main stiles 1 of the ladder. More particularly, each rung 5 comprises two elements 5*a*, 5*b* articulated together about an axis 6 which constitutes the axis of the central hinge of each rung. Moreover, the two elements 5*a*, 5*b* are articulated to the respective main stiles 1 about axes 7,8. Finally, the elements 5*a* are all connected together by a rod 9 which is articulated to each of the elements 5*a*.

The auxiliary stile 3 is connected to the top rung 5 by means of a tie rod 10 articulated at one end to the rung 5 and carrying at its opposite end a sliding block 11, which is slidable in a longitudinal guide groove 12 formed in the auxiliary stile 3.

With reference to FIG. 6, the two main stiles 1 are constituted by profiled elements of channel section with the channels open towards each other.

By virture of the particular structure and disposition described above, the ladder according to the invention can adopt both an extended operative configuration, illustated in FIGS. 1 and 7, in which the two main stiles 1 and the auxiliary stile 3 are spaced from each other and the rungs 5 are located in their extended operative configurations, and a folded inoperative configuration, illustrated in FIGS. 5 and 8, in which the two main stiles 1 and the auxiliary stile 3 are alongside each other.

With reference to FIG. 7, each rung 5 has stop surfaces 13 at its ends for cooperating with the inner surfaces of the profiled elements constituting the two main stiles 1, so as to stop the rungs 5 in their extended operative configurations. The two profiled elements constituting the main stiles 1 have two longitudinal edges 1*a* which are alongside each other in the folded condition of the ladder and in which two recesses 14 are formed that, in the folded condition, define an aperture 15 into which the user may his hands so as easily to extend the ladder into its extended operative configuration. When the ladder must be closed from its operative condition to the folded condition illustrated in FIG. 5, however, the connecting rod enables action on a single rung 5 to cause the simultaneous folding of all the rungs 5 into the condition illustrated in FIG. 8.

With reference to FIGS. 9 and 10, each rung element may be constituted by a profiled element with a substantially C-shaped section (see FIG. 5) and the articulation of this element to the respective stile 1 may be achieved by pins 16. Each rung element has a bearing surface 17 oriented so as to lie in a horizontal plane in the extended operative condition of the ladder.

In the folded inoperative condition, the ladder may be converted into a coat stand. In this case, the ladder has a support base 18 which, in the example illustrated, has a substantially conical shape with a seat 19 in the centre of its upper wall for receiving the lower ends of the two main stiles 1 and the auxiliary stile 3. In the example illustrated, sockets 20 are formed in the stiles for receiving two vertical pins 21 (only one of which is visible in FIG. 11) which project upwardly from the bottom of the seat 19 and ensure the necessary stability of the ladder in the folded inoperative configuration.

When the ladder is also to be used as a coat stand in the inoperative condition, it has auxiliary appendages 22 to act as coat hooks. Each pair of appendages 22 is defined by an element 23 in the form of a flattened strip which passes through corresponding slots 24 formed in the walls of the two main stiles 1.

FIGS. 2, 3 and 4 illustrate in section the three elements 23 which are provided in the embodiment of the ladder according to the invention illustrated in the drawings, in the position corresponding to the open operative configuration of the ladder. FIG. 6 shows the three corresponding sections superimposed on each other in the folded inoperative condition of the ladder, that is in the configuration in which the ladder can be used as a coat stand. As can be seen from the drawings, the movement of the ladder from the folded configuration to the extended condition and vice versa causes a movement of the profiled elements constituting the two main stiles 1 relative to the elements 23 and a consequent rotation of these elements about the central vertical axis of the ladder.

Naturally, the principle of the invention remaining the same, the constructional details may be varied widely with respect to that described and illustrated purely by way of example, without thereby departing from the scope of the present invention.

I claim:

1. A ladder comprising:

a pair of main stiles;

a series of rungs with central hinges and ends articulated to the two main stiles, whereby the ladder can adopt a folded inoperative configuration in which the main stiles are alongside each other and an extended operative configuration in which the main stiles are spaced from each other, and means for stopping the ladder in the extended operative configuration, wherein the main stiles are articulated together at their upper ends about an axis and the ladder further includes a single auxiliary stile articulated at its upper end to the two upper ends of the main stiles about an axis substantially perpendicular to the articulation axis of the two main stiles, the auxiliary stile being movable between a position alongside the two main stiles, corresponding to the folded inoperative condition of the ladder, and a position spaced from the main stiles, corresponding to the extended operative condition of the ladder.

2. A ladder as defined in claim 1, wherein each rung has stop surfaces at its ends for cooperating with the main stiles to hold each rung in the extended operative configuration.

3. A ladder as defined in claim 1, wherein the stop means include a tie rod having one end articulated to one of the rungs of the ladder, and a longitudinal guide groove in the auxiliary stile in which the opposite end of the tie rod is slidable.

4. A ladder as defined in claim 1, wherein the two main stiles are formed by two profiled elements of channel section, with the channels open towards each other.

5. A ladder as defined in claim 4, wherein the two main stiles define a pair of recesses in two respective longitudinal edges which are alongside each other in the folded inoperative condition of the ladder.

6. A ladder as defined in claim 1, wherein the ladder has auxiliary appendages and a support base for allowing the ladder to be used as a coat stand when in its folded inoperative condition.

7. A ladder as defined in claim 6, wherein two of the stiles have respective apertures and the auxiliary appendages are each defined by a single element passing through said apertures and having ends in the form of coat hooks located outside the two stiles.

8. A ladder as defined in claim 7, wherein each of the elements constituting the auxiliary appendages has at least an intermediate portion in the form of a strip.

9. A ladder as defined in claim 6, wherein the support base has a seat for receiving the lower ends of the ladder stiles with a positive fit.

10. A ladder as defined in claim 9, wherein the two vertical projections are provided in the seat of the support base and the lower end of each stile has a socket for one of the projections.

* * * * *